US007374505B2

(12) United States Patent
Polando

(10) Patent No.: US 7,374,505 B2
(45) Date of Patent: May 20, 2008

(54) BROADHEAD ADAPTER AND ARROW

(76) Inventor: Scott A. Polando, 2945 Birch Grove Ct., Oxford, MI (US) 48370

( * ) Notice: Subject to any disclaimer, the term of this patent is extended or adjusted under 35 U.S.C. 154(b) by 0 days.

(21) Appl. No.: 11/160,063

(22) Filed: Jun. 7, 2005

(65) Prior Publication Data

US 2006/0276276 A1 Dec. 7, 2006

(51) Int. Cl.
*F42B 6/08* (2006.01)

(52) U.S. Cl. ..... 473/584

(58) Field of Classification Search ..... 473/583, 473/584

See application file for complete search history.

(56) References Cited

U.S. PATENT DOCUMENTS 4,254,958 A * 3/1981 Bateman, III ..... 473/583
4,505,482 A 3/1985 Martin, Sr.
5,137,282 A 8/1992 Segar et al.
6,283,880 B1 * 9/2001 Barrie ..... 473/584
6,290,903 B1 9/2001 Grace, Jr. et al.
6,540,628 B1 * 4/2003 Musacchia, Jr. ..... 473/583
6,595,881 B1 7/2003 Grace, Jr. et al.
6,605,012 B2 8/2003 Muller
6,726,581 B2 4/2004 Muller
6,887,172 B2 5/2005 Arasmith
6,939,258 B2 9/2005 Muller
2005/0181898 A1 8/2005 Muller

* cited by examiner

*Primary Examiner*—John A. Ricci
(74) *Attorney, Agent, or Firm*—Gregory T. Zalecki

(57) ABSTRACT

A broadhead adapter may be used to convert a field tip arrow to an arrow having a broadhead arrowhead. A broadhead adapter is comprised of a collar and at least one broadhead arrow blade. The collar is adapted to receive the stud of a field tip through an opening. The collar is adapted to securely fit between an end of an arrow shaft and the shoulder of the field tip. Each broadhead arrow blade is attached to the collar to form an arrowhead configuration. The outer perimeter of the collar should have substantially the same dimensions as the outer perimeter of the end of the arrow shaft. An arrow having a broadhead arrowhead may be formed by securing a broadhead adapter between the shoulder of a threaded arrow field tip and the threaded opening of an arrow shaft.

11 Claims, 5 Drawing Sheets

BROADHEAD ADAPTER AND ARROW

BACKGROUND

Archers use different types of arrows for different purposes. Two commonly used types of arrows are field tip arrows and broadhead arrows. A field tip arrow has a conical pointed head. It is typically used for target practice. A common broadhead arrow has a plurality of tapered blades having cutting edges. The tapered blades converge at a tip and form an arrowhead configuration. A broadhead arrow is typically used for hunting. Modern arrow shafts have threaded inserts at one end. Typical field tips and broadhead arrowheads have projecting threaded studs adapted to thread into the threaded insert of an arrow shaft.

Because typical field tips and broadhead arrowheads have projecting threaded studs, arrowheads can be quickly removed and replaced. The original arrowhead is unscrewed from the arrow shaft. The replacement arrowhead is screwed into the arrow shaft. This permits a field tip arrow to be quickly converted to a broadhead arrow by facilitating the replacement of a field tip arrowhead on an arrow shaft with a broadhead arrowhead. Similarly, a broadhead arrow can be converted to a field tip arrow by replacing the broadhead arrowhead with a field tip arrowhead. Damaged arrowheads can also be repaired by unscrewing the damaged arrowhead from the arrow shaft and replacing it with another arrowhead.

It is desirable to reduce the weight and manufacturing cost of broadhead arrowheads. It is also desirable to provide an arrowhead which facilitates the conversion of a field tip arrow to a broadhead arrow while still maintaining the connection between the field tip arrowhead and the arrow shaft.

What is needed is a broadhead adapter which facilitates the conversion of a field tip arrow to a broadhead arrow wherein the adapter does not have a threaded stud. Instead, the broadhead adapter should have a collar through which the stud of a field tip would fit for securing the adapter to an arrow shaft. The adapter should be able to be manufactured at a lower cost than current broadhead arrowheads. It should weigh less than similarly shaped current broadhead arrowheads. It should provide for the quick and economical repair of damaged broadheads. It should enhance and not detract from the aerodynamic properties of the arrow. The broadhead adapter should be capable of forming a fully functional broadhead arrow when the adapter is attached to an arrow shaft by a field tip.

SUMMARY

These needs are satisfied by a broadhead adapter and an arrow incorporating the broadhead adapter described herein. A broadhead adapter is comprised of a collar and at least one broadhead arrow blade. The collar has an opening. The collar is adapted to receive the stud of a shouldered fastener having a projecting stud, through the opening. The fastener can be a bolt having a threaded stud. Preferably, it is a threaded arrow field tip having a shoulder. The collar is adapted to securely fit between one of the ends of an arrow shaft and the shoulder of a bolt, field tip or shouldered fastener having a projecting stud, when that projecting stud is inserted through the opening of the collar.

Broadhead arrow blades have elongated cutting edges. At least one broadhead arrow blade is attached to the collar. Many currently used broadhead arrow blades are generally triangular in shape. A generally triangular shaped broadhead arrow blade can be used with the broadhead adapter described herein, although such a shape is not necessary. The broadhead arrow blade is attached to the collar such that an arrowhead configuration is formed.

A threaded arrow field tip has a conical pointed tip at one end and a projecting stud at the other end. Other types of field tip tips, such as chisel tips, are also commonly available. The projecting stud of a field tip is attached to the pointed end portion of the field tip at a shoulder. The projecting stud usually has two diameters. The larger diameter portion of the stud is usually unthreaded and attached to the pointed end portion of the field tip. The smaller diameter portion of the stud is threaded such that it can be screwed into the end of an arrow shaft.

The broadhead adapter is intended to be attached to an arrow shaft. Most arrow shafts are cylindrical and therefore have a circular outer perimeter. The collar has an inner perimeter defining its opening. The collar also has an outer perimeter which is defined by its external periphery. Preferably, the outer perimeter of the collar has substantially the same dimensions as the outer perimeter of the arrow shaft at an end of the arrow shaft.

Commonly available arrow shafts have a threaded opening at one end. The threads of the threaded opening are contained within an insert. The insert is inserted into the end of the arrow shaft to create an arrow shaft having a threaded opening at one end. The entrance section of the insert is that section of the opening surface of the insert most distal to the arrow shaft-insert assembly. The entrance section is planar and perpendicular to the longitudinal axis of the insert. In order to minimize aerodynamic flight interference caused by the broadhead adapter, the outer perimeter of the collar may have the same dimensions as the outer perimeter of the entrance section of the threaded insert.

An arrow incorporating a broadhead adapter is comprised of an arrow shaft, a bolt and a broadhead adapter. The arrow shaft has a threaded opening at one end. The broadhead adapter is a broadhead adapter as described herein. The bolt has a threaded stud and a shoulder. Preferably it is in the form of an arrow field tip. The collar of the broadhead adapter is positioned between the shoulder of the bolt and the threaded opening of the arrow shaft. The broadhead adapter is securely attached to the end of the arrow shaft by meshing the threaded stud with the threads within the threaded opening of the arrow shaft. Thus, the broadhead adapter is secured to the arrow shaft by screwing the bolt or field tip into the threaded arrow shaft.

It may be desirable to minimize the overlap between the broadhead arrow blades of the broadhead adapter and the arrow shaft. When the broadhead adapter is attached to the arrow shaft any portion of the broadhead blades which extends into the area between the two ends of the arrow shaft will reduce the effective length of the arrow. In other words, the arrow when equipped with a field tip only, may be drawn back a certain maximum distance prior to releasing the arrow from the bow toward the target. The maximum draw distance is reduced by a small amount to a lesser distance when the blades of a broadhead adapter extend between the ends of the arrow shaft.

The extension of the broadhead blades into the area between the ends of the arrow shaft may be reduced by using an elongated cylindrical body as the collar. This will permit the blades to be attached to the collar further from the threaded opening of the arrow shaft. Another way to reduce the intrusion of the broadhead blades into the area between the ends of the arrow shaft is to attach each broadhead blade to a projection emanating from the collar. The collar has a longitudinal axis passing through the center of its opening. The projection is substantially parallel to this longitudinal axis of the collar and projects in a direction away from the intended connection interface between the collar and the end of the arrow shaft.

The preferred broadhead adapter avoids the extension of any broadhead blade, or part thereof, into the area between the ends of the arrow shaft. Each broadhead blade of the preferred embodiment has a forward end and a rearward end. Forward end and rearward end refer to the blade orientations when the broadhead adapter is secured to an arrow shaft. The forward end is most distal to the arrow shaft. The rearward end is most proximal to the arrow shaft. The rearward end of each blade is attached to the collar. Each broadhead blade is shaped to provide an opening for insertion, tightening and removal of the bolt or field tip. This is accomplished by configuring each blade so that a cavity within which the field tip sits when the adapter is attached to an arrow shaft is provided. The cavity should be sufficiently sized and shaped to allow for manual insertion, tightening and removal of a bolt or a field tip. Preferably, the broadhead adapter has two or three cutting edges surrounding the opening.

DRAWINGS

These and other features, aspects, and advantages of the present invention will become better understood with regard to the following description, appended claims, and accompanying drawings where:

DETAILED DESCRIPTION

Figure 13:
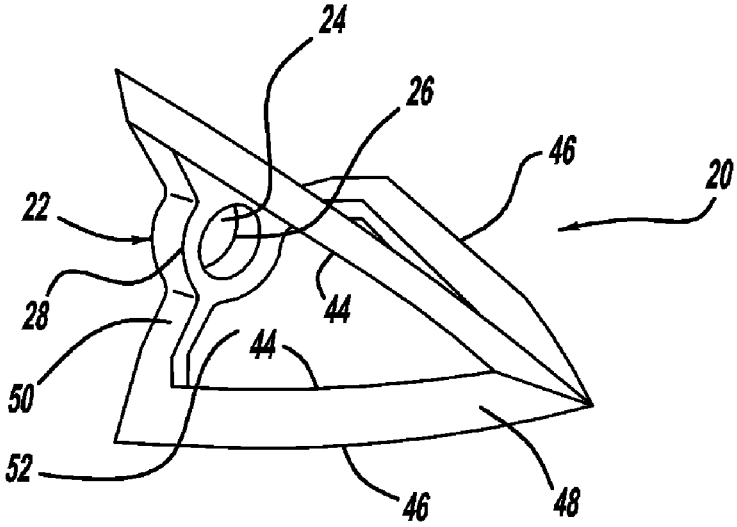
FIG. 13 is a perspective view of another embodiment of a broadhead adapter.
Figure 14:
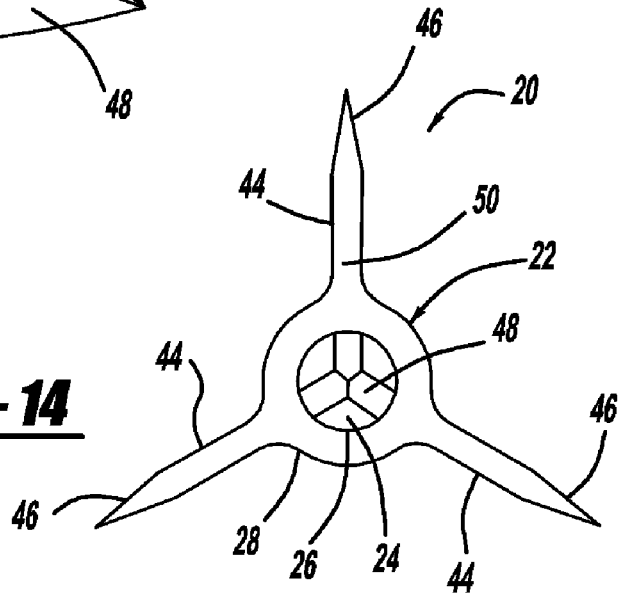
FIG. 14 is a bottom view of the broadhead adapter of FIG. 13.

Six embodiments of a broadhead adapter 20 are shown in FIGS. 2, 5, 6, 7, 8, and 13, respectively. FIGS. 2, 4, 5, 6, 7, 8, and 9 depict partial views of arrows 56 incorporating a broadhead adapter 20. The preferred embodiment of a broadhead adapter 20 is shown in FIG. 13. Broadhead adapters 20 can be fabricated from plastic or metal. They can be produced by metal stamping. They can be produced by plastic injection molding. They can be produced by metal injection molding. The preferred fabrication method is metal injection molding.

Figure 1:
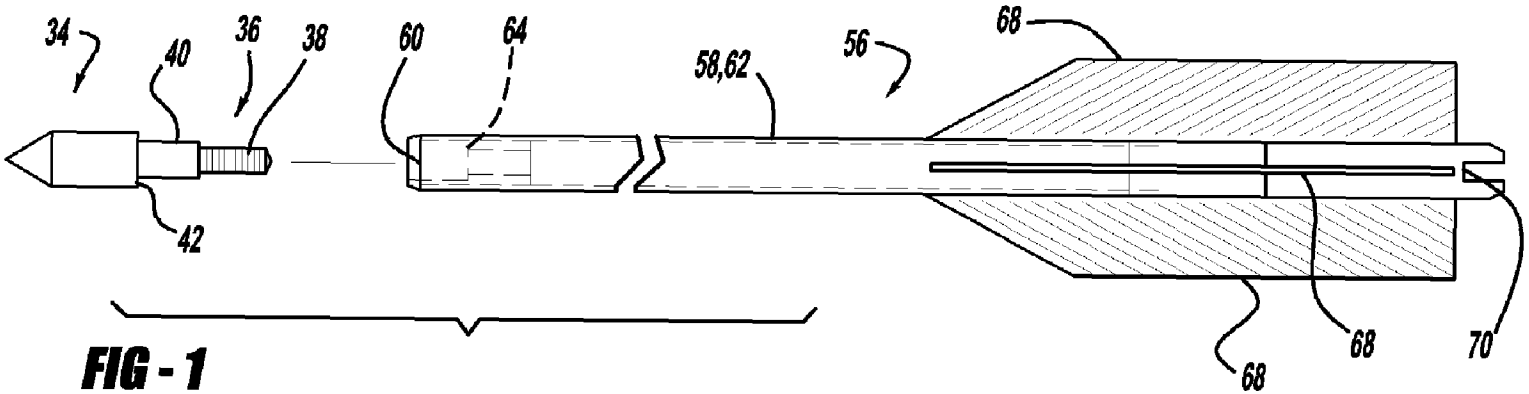
FIG - 1 Prior Art
FIG. 1 is an exploded plan view showing an arrow having an arrow shaft with a threaded opening at one end and a threaded field tip

A broadhead adapter 20 is intended to be attached to an arrow shaft 58. An exploded view of an arrow 56 is shown in FIG. 1. A common field tip arrow 56 is comprised of a threaded arrow field tip 34 and an arrow shaft 58. The arrow shaft 58 is cylindrical and has a circular outer perimeter 62 around its cross-section. One end of the arrow shaft 58 has a plurality of feathers 68 for flight guidance and a notch 70. The notch 70 is adapted to receive the drawstring of a bow and is the location where the drawstring imparts a flight propelling force to the arrow 56. The other end of the arrow shaft 58 has a threaded opening 60. The threads of the threaded opening 60 are provided by a threaded insert 64. The threaded insert 64 is inserted into the end of the arrow shaft 58 opposite the notch 70. The entrance section of the threaded insert 64 is the planar area which is perpendicular to the longitudinal axis of the arrow shaft 58 and which is most distal to the notch 70 of the arrow 56. The outer perimeter 66 of the entrance section of the threaded insert 64 is typically circular and is often smaller than the outer perimeter 62 of a cross-section of the arrow shaft 58.

A common threaded arrow field tip 34 is also shown in FIG. 1. The field tip 34 screws into the threaded insert 64 of the arrow shaft 58. The field tip 34 has a projecting stud 36. The projecting stud 36 attaches to a conical pointed head at a shoulder 42. The projecting stud 36 has a threaded portion 38 and an unthreaded portion 40. The unthreaded portion 40 of the projecting stud 36 attaches to the head of the field tip 34. The threaded portion 38 of the projecting stud 36 projects from the unthreaded portion 40. The threaded portion 38 of the projecting stud 36 is threaded such that it may be screwed into the threaded insert 64 of the arrow shaft 58. The head of the field tip 34 may have a shape other than the shape of a pointed cone. For example, the field tip 34 may have a chisel tip.

A broadhead adapter 20 is comprised of a collar 22 and at least one broadhead arrow blade 44. The collar 22 has an opening 24. The collar 22 is adapted to receive the stud 36 of a shouldered fastener 34 having a projecting stud 36. The projecting stud 36 is received through the opening 24 of the collar 22. Preferably, the shouldered fastener 34 is a threaded arrow field tip 34. It may also be a bolt 34. It may be any type of fastener which has a projecting stud and a shoulder, so long as the projecting stud 36 is adapted to be releasably retained within an opening 60 of an arrow shaft 58. For example, spring-loaded detents may be used to secure the fastener 34 to the arrow shaft 58. The projecting stud 36 of the fastener 34 may also be releasably secured to the arrow shaft 58 by friction fitting the projecting stud 36 within the opening 60 of the arrow shaft 58. The broadhead adapter 20 will be secured to the arrow shaft 58 by the fastener 34. Preferably, the fastener 34 is a threaded arrow field tip 34 or a common bolt threaded to mesh with the threads of the threaded insert 64 within the arrow shaft 58.

The preferred shape of the collar 22 is substantially the shape of a common washer. The collar 22 should have a circular opening 24. The opening 24 is defined by an inner perimeter 26 of the collar 22. An outer perimeter 28 of the collar 22 is defined by the external periphery of the collar 22. Preferably, the outer perimeter 28 of the collar 22 is generally circular with a plurality of necks 54 extending therefrom for attaching to broadhead arrow blades 44.

The preferred basic shape of the collar 22 is the shape of a washer. The opening 24 of the collar 22 has an inner perimeter 26 which allows the threaded stud 36 of a threaded arrow field tip 34 to pass through. The outer perimeter 28 of the collar 22 should have substantially the same dimensions as the outer perimeter 62 of the arrow shaft 58. In other words, the outer diameter of a washer shaped collar 22 should be substantially the same as the outer diameter of the arrow shaft 58 to which it is to be attached. By matching the outer perimeter 28 of the collar 22 to the outer perimeter 62 of the arrow shaft 58 flight characteristics of the arrow 56 will be enhanced. Such matching will minimize any adverse aerodynamic flight effects caused by the collar 22. Some threaded inserts 64 have a smaller cross-section diameter than the diameter of the arrow shaft 58, 62, as shown in FIG. 1. Additional optimization of the flight characteristics of the arrow may be obtained by fabricating the collar 22 such that its outer perimeter 28 has substantially the same dimensions as the outer perimeter 66 of the entrance section of the threaded insert 64 which has been inserted into the end of the arrow shaft 58. The collar 22 is adapted to securely fit between an end of an arrow shaft 58 and the shoulder of a bolt, fastener or field tip 34. These characteristics can be achieved by forming the collar 22 in the shape of a washer wherein the outside diameter 28 of the collar 22 is the same as the outside diameter 62 of the arrow shaft 58, and wherein the inside diameter 26 of the collar 22 forms an opening 24 having slightly larger dimensions than the diameter of the stud 36 of the bolt, field tip or fastener 34 intended to be inserted through it.

Figure 2:
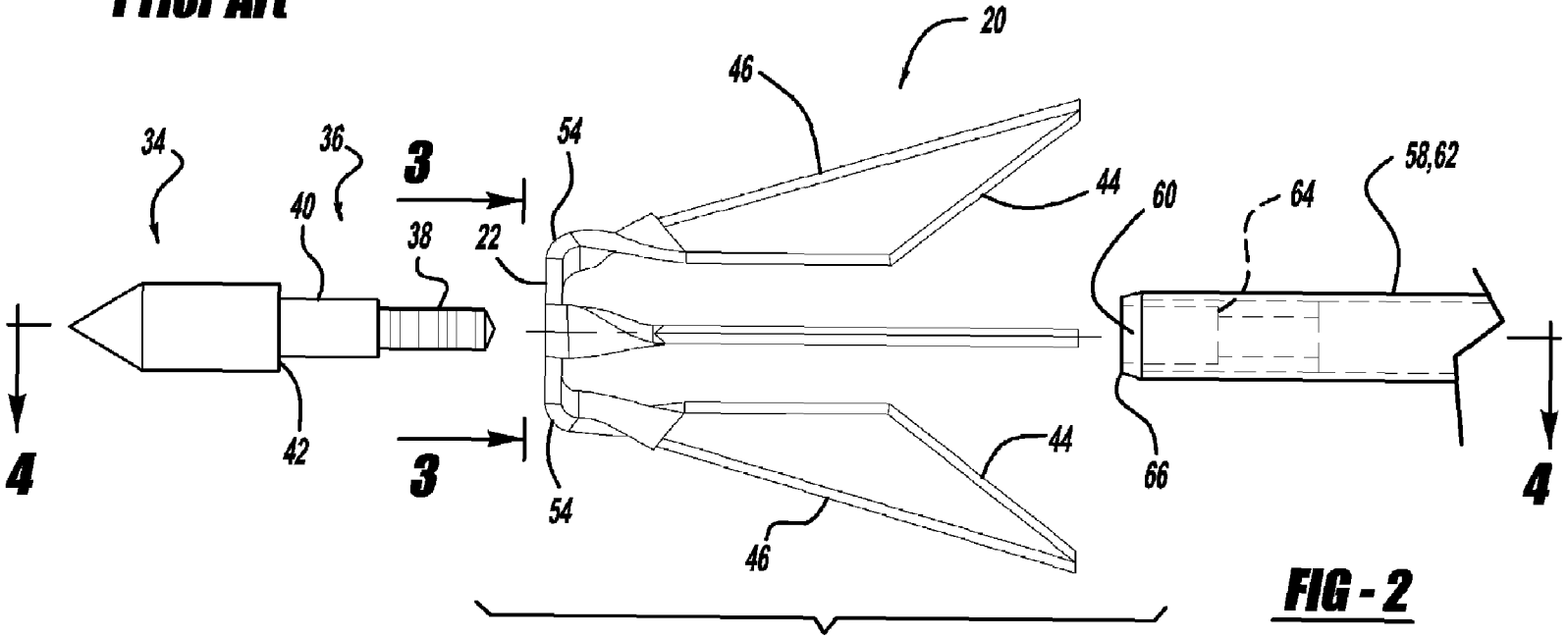
FIG. 2 is an exploded plan view of the arrow shaft and the threaded field tip of FIG. 1 with a broadhead adapter positioned between the threaded field tip and the arrow shaft.
Figure 4:
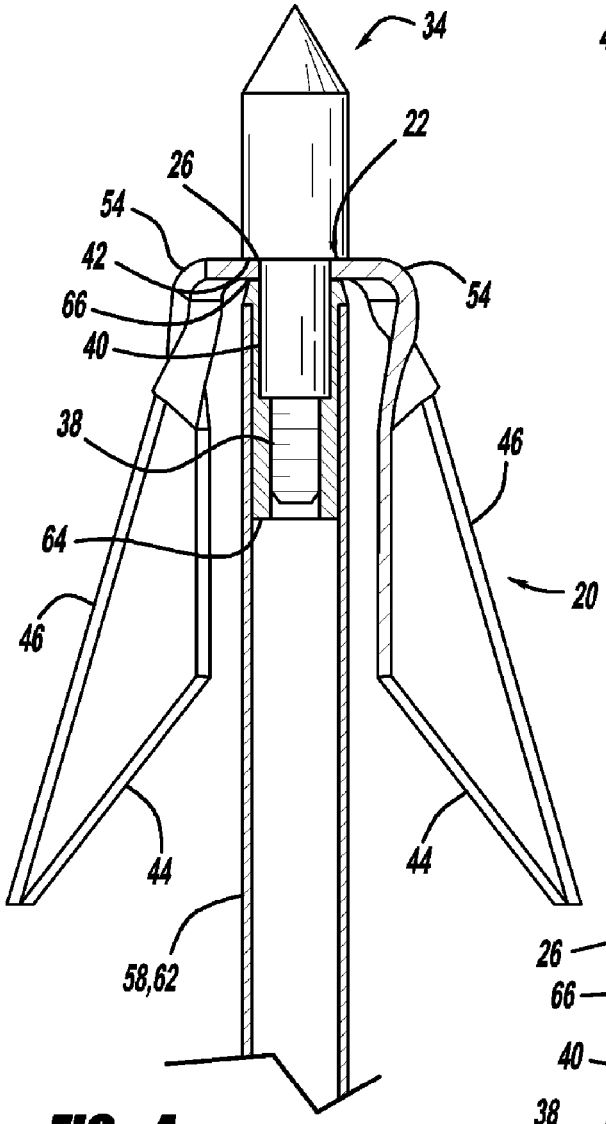
FIG. 4 is an elevation sectional view showing the threaded field tip, the broadhead adapter and the arrow shaft of FIG. 2 assembled together.
Figure 3:
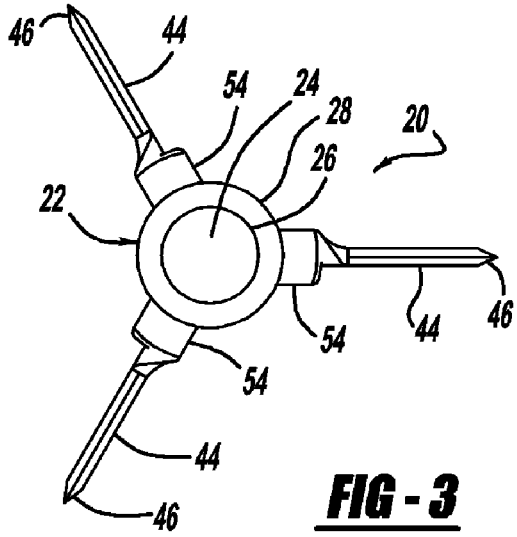
FIG. 3 is a top view of the broadhead adapter of FIG. 2.

At least one broadhead arrow blade 44 is attached to the collar 22. Broadhead arrow blades 44 have elongated cutting edges 46. They are often triangular in shape. A broadhead arrow blade 44 may be attached to the collar 22 by a neck 54. FIG. 2 shows a collar 22 transitioning to an attached broadhead arrow blade 44 through a neck 54. The collar 22, neck 54 and broadhead arrow blade 44 have been stamped from metal.

It is desirable to avoid having broadhead arrow blades 44 of a broadhead adapter 20 entering the area between the ends of the arrow shaft 58. As indicated above, when the broadhead arrow blades 44 enter into this area the effective draw length of the arrow 56 is reduced. This is because an arrow 56 loaded into a bow may be drawn back further when the arrow terminates only with a field tip 34 than when the broadhead arrow blades 44 enter the area between the ends of the arrow shaft 58.

Figure 5:
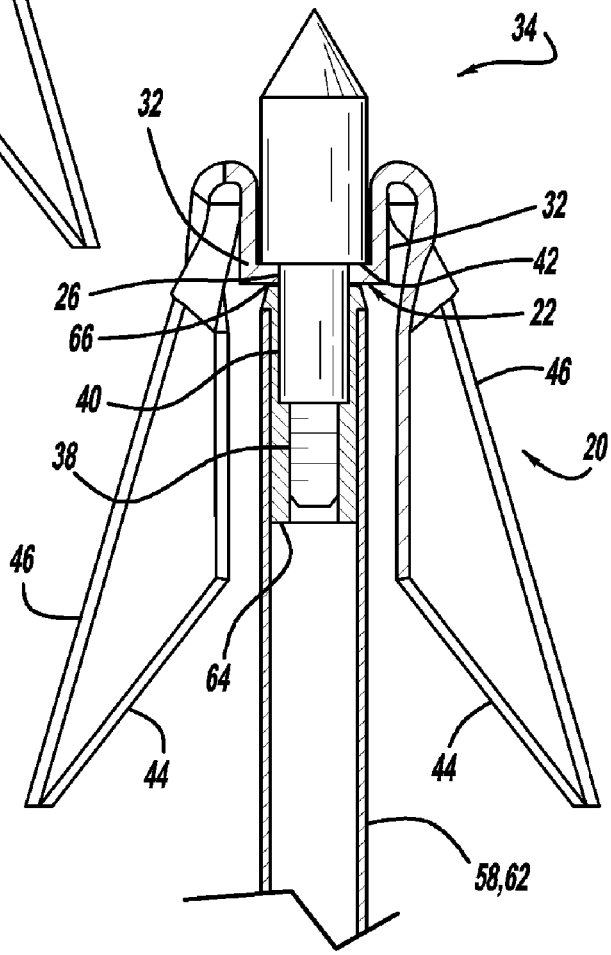
FIG. 5 is an elevation sectional view of an alternate embodiment of a broadhead adapter showing the threaded field tip, the broadhead adapter and the arrow shaft assembled together.
Figure 6:
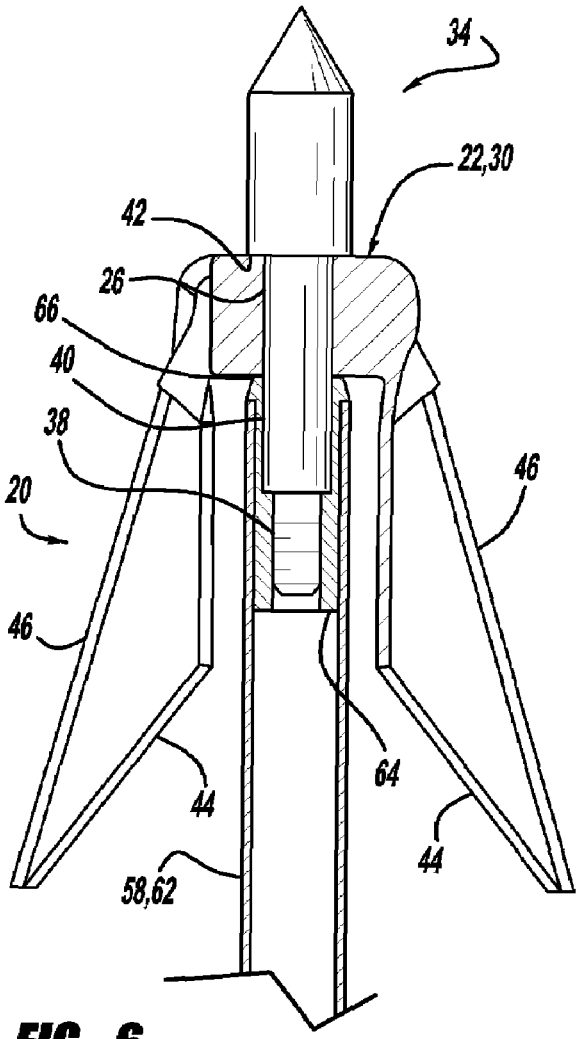
FIG. 6 is an elevation sectional view of another embodiment of a broadhead adapter attached to the threaded end of an arrow shaft by a threaded field tip.
Figure 7:
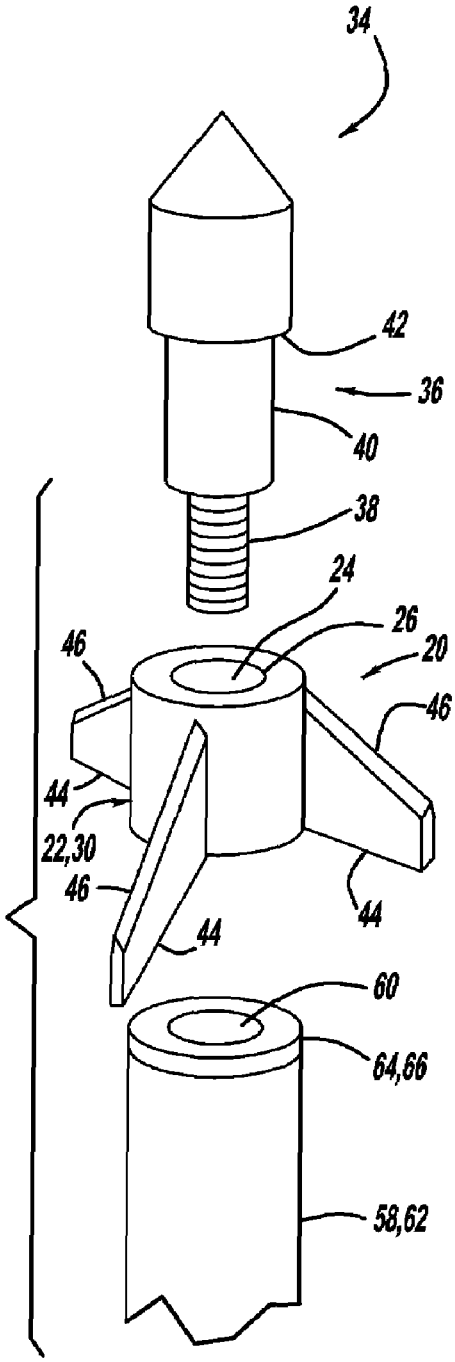
FIG. 7 is an exploded elevation view of another embodiment of a broadhead adapter together with a threaded field tip and an arrow shaft having a threaded opening at one end.

FIGS. 5, 6 and 7 show alternate embodiments of broadhead adapters 20 which reduce the intrusion of their broadhead arrow blades 44 into the area between the ends of the arrow shaft 58. In FIG. 5 the collar 22 has two projections 32. The collar 22 has a longitudinal axis which passes through the center of the opening 24 of the collar. This longitudinal axis would coincide with the longitudinal axis of an arrow shaft 58 when the collar 22 is attached to the arrow shaft 58. Each projection 32 emanates from the outer periphery of the collar 22 and is substantially parallel to the longitudinal axis of the collar. The projections 32 project away from the threaded opening 60 of the arrow 56 when the collar 22 is attached to the arrow shaft 58. The broadhead arrow blades 44 are attached to the projections 32 such that any intrusion of the broadhead arrow blades 44 into the area between the ends of the arrow shaft 58 is reduced.

FIG. 6 and FIG. 7 show additional ways to reduce the intrusion of the broadhead arrow blades 44 into the area between the ends of the arrow shaft 58. Each drawing shows a collar 22 which is comprised of an elongated cylindrical body 30. The elongation of the collar 22, 30 permits the broadhead arrow blades 44 to be withdrawn from the area between the ends of the arrow shaft 58 by providing a connecting surface further from the threaded opening 60 of the arrow shaft 58. In order to use the embodiments shown in FIG. 6 and FIG. 7 a longer field tip, bolt or fastener 34 may be needed.

Figure 8:
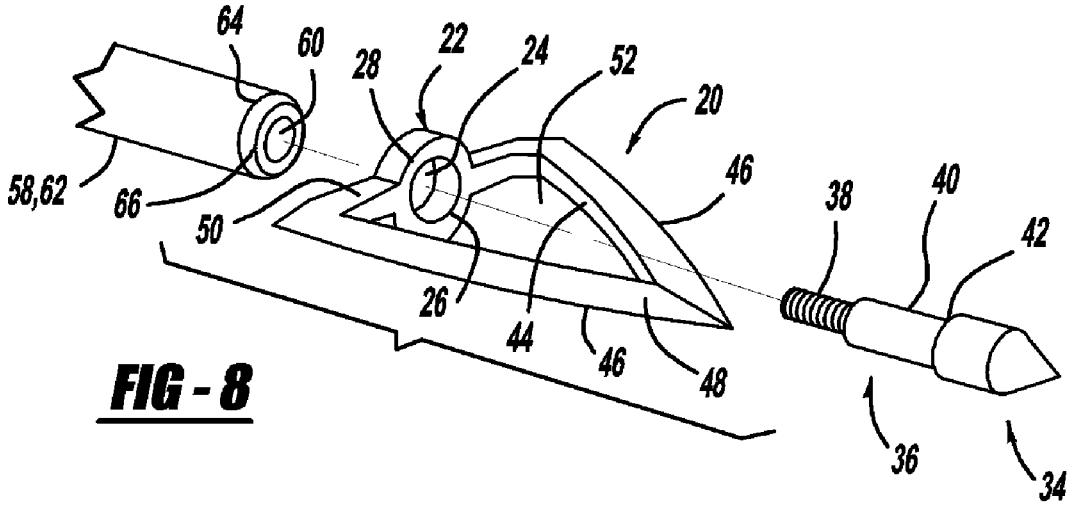
FIG. 8 is an exploded perspective view showing another embodiment of a broadhead adapter, a threaded field tip and an arrow shaft having a threaded opening at one end.
Figure 9:
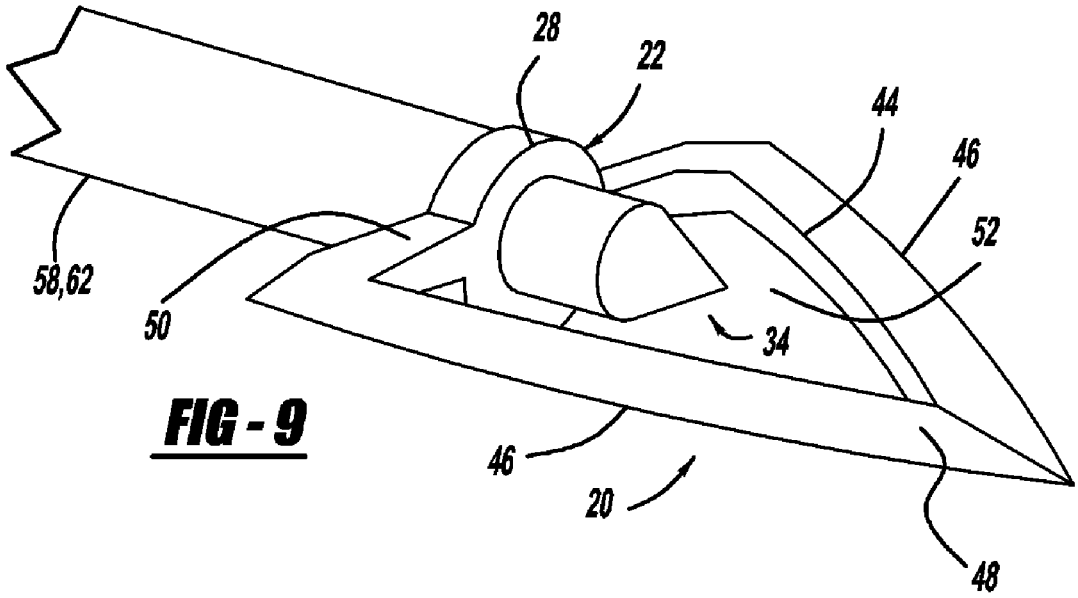
FIG. 9 is a perspective view of the arrow shaft, the broadhead adapter and the threaded field tip of FIG. 8 assembled together.
Figure 10:
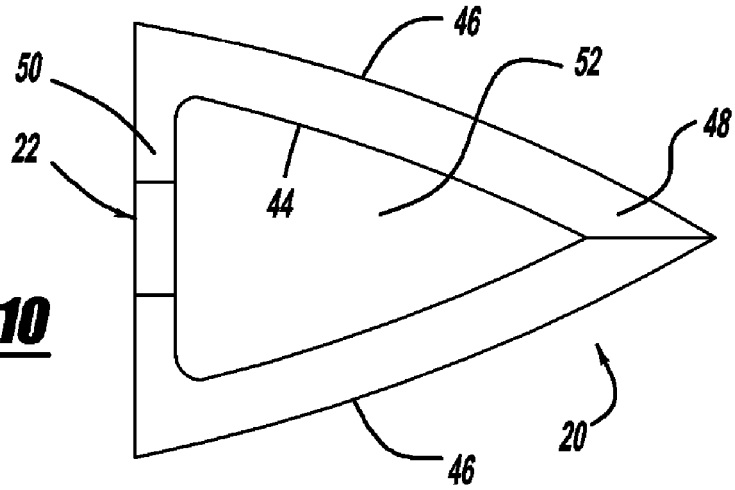
FIG. 10 is a side view of the broadhead adapter of FIG. 8.
Figure 11:
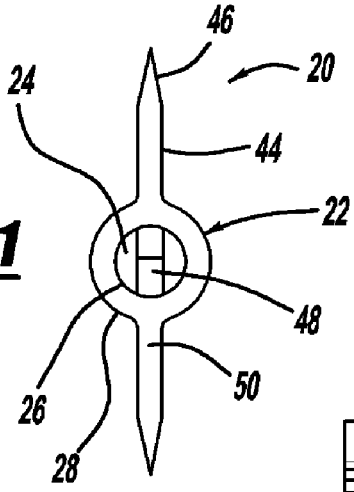
FIG. 11 is a bottom view of the broadhead adapter of FIG. 8.
Figure 12:
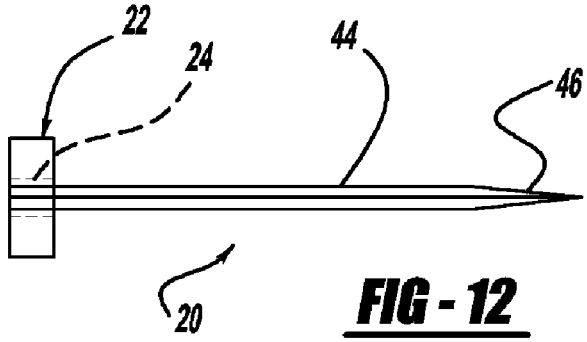
FIG. 12 is another side view of the broadhead adapter of FIG. 8, wherein the broadhead adapter has been rotated 90 degrees around its longitudinal axis relative to the orientation shown in FIG. 10.

The broadhead adapter 20 embodiments shown in FIG. 8 and FIG. 13 maintain the broadhead arrow blades 44 in a position that does not intrude into the area between the ends of the arrow shaft 58. The broadhead arrow blades 44 in those figures can be viewed as a single blade or as a combination of generally triangular blades 44 joined at a tip. Each broadhead arrow blade 44 has a forward end and a rearward end. Forward end and rearward end refer to the blade orientations when the broadhead adapter 20 is secured to an arrow shaft 58. The rearward end of each blade 44 is attached to the collar. Each broadhead blade 44 is shaped to provide an opening 52. The shape of the opening 52 permits insertion, tightening and removal of a bolt 34 or a field tip 34. This is accomplished by configuring each blade 44 so that a cavity 52 within which the field tip 34 sits when the adapter 20 is attached to an arrow shaft 58 is provided, as shown in FIG. 9. The cavity 52 should be sufficiently sized and shaped to allow for manual insertion, tightening and removal of a bolt 34 or a field tip 34. Preferably, the broadhead adapter 20 has two or three cutting edges 46 surrounding the opening 52, as shown in FIG. 9 and FIG. 13, respectively. The outer perimeter 28 of the collar 22 should be optimized to match the outer perimeter 62 of the arrow shaft 58 or the outer perimeter 66 of the threaded insert 64, as previously described.

An arrow 56 incorporating a broadhead adapter 20 is comprised of a broadhead adapter 20, a bolt 34 and an arrow shaft 58. The arrow shaft 58 has a threaded opening 60 at one end. The threaded opening 60 should be provided by a threaded insert 64 inserted into an end of the arrow shaft 58, as previously described. The other end of the arrow shaft 58 is equipped with feathers 68 and a notch 70, as shown in FIG. 1. The bolt 34 has a threaded stud 36 projecting from it. A shoulder is provided where the stud 36 meets the head of the bolt 34. Preferably, the bolt 34 is a threaded arrow field tip 34, as described. However, it may be a shouldered fastener having a projecting stud, as previously described. The broadhead adapter 20 is as previously described. Any of the described embodiments may be used. In order to form an arrow 56 the collar 22 of the broadhead adapter 20 is positioned between the shoulder 42 of the bolt 34 and the threaded opening 60 of the arrow shaft 58. The broadhead arrow blades 44 are oriented to form an arrowhead configuration at the end of the arrow shaft 58 having the threaded opening 60. The broadhead adapter 20 is securely attached to the end of the arrow shaft 58 by threading the threads of the bolt 34 into the threads of the threaded opening 60 of the arrow shaft 58. The threads of the threaded stud 36, 38 are meshed with the threads within the threaded opening 60 of the arrow shaft 58. The threads within the threaded opening 60 of the arrow shaft 58 are provided by the threaded insert 64.

In order to convert a field tip arrow 56 into a broadhead arrow 56 the field tip 34 is removed by unscrewing it. The collar 22 of a broadhead adapter 20 is positioned between the shoulder 42 of the threaded arrow field tip 34 and the threaded opening 60 of the arrow shaft 58. The broadhead adapter 20 is securely attached to the end of the arrow shaft 58 by threading the threads of the field tip 34 into the threads of the threaded opening 60 of the arrow shaft 58 and tightening the field tip 34. In order to convert the arrow 56 back into a field tip arrow 56 the process is reversed. The field tip 34 is unscrewed from the threaded opening 60 of the arrow shaft 58 and the broadhead adapter 20 is removed. The threaded arrow field tip 34 is screwed back into the threaded opening 60 of the arrow shaft 58, thereby converting the arrow 56 into a field tip arrow 56. A damaged broadhead adapter 20 may be easily replaced. The field tip 34 or bolt 34 is unscrewed from the arrow shaft 58. The damaged broadhead adapter 20 is removed and replaced by an undamaged broadhead adapter 20. The undamaged broadhead adapter 20 is then secured by tightening the field tip 34 or bolt 34.

The broadhead adapter 20 does not have a threaded stud. The broadhead adapter 20 facilitates the conversion of a field tip arrow 56 to a broadhead arrow 56. The broadhead adapter 20 can be manufactured at a lower cost than current broadhead arrowheads because it contains less material than similarly shaped broadhead arrowheads and it does not require the machining, or otherwise providing, of threads onto a stud. The broadhead adapter 20 provides for the quick and economical repair of damaged arrowheads. It also provides for the quick conversion of a field tip arrow 56 to a broadhead arrow 56 and the conversion of a broadhead arrow 56 to a field tip arrow 56. The broadhead adapter 20 does not adversely affect the aerodynamic properties of an arrow 56. The broadhead adapter 20 is capable of forming a fully functional broadhead arrow 56 when the adapter 20 is attached to an arrow shaft 58 by a field tip 34.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions and methods insofar as they do not depart from the spirit and scope of the present invention.

What is claimed is:

1. A broadhead adapter comprising:

a collar having an opening, said collar being adapted to receive the stud of a bolt having a projecting stud through the opening and said collar being adapted to securely fit between an end of an arrow shaft and the shoulder of the bolt; and at least one broadhead arrow blade attached to the collar to form a broadhead arrowhead configuration, wherein the collar has at least one projection substantially parallel to a longitudinal axis of the collar, said longitudinal axis passing through the center of the opening of the collar, and each said projection having one of the at least one broadhead arrow blades attached to it.

2. A broadhead adapter comprising:

a collar having an opening, said collar being adapted to receive the stud of a bolt through the opening and said collar being adapted to securely fit between an end of an arrow shaft and the shoulder of the bolt; and at least one broadhead arrow blade attached to the collar to form a broadhead arrowhead configuration, wherein each broadhead arrow blade has a forward end and a rearward end, wherein the rearward end of each blade is attached to the collar and wherein each broadhead blade is shaped to provide an opening for insertion, tightening and removal of the bolt.

3. The broadhead adapter of claim 2, wherein the bolt is a threaded arrow field tip having a shoulder.

4. The broadhead adapter of claim 2, wherein each broadhead blade is generally triangular in shape.

5. The broadhead adapter of claim 2, wherein the collar has an inner perimeter defining the opening and an outer perimeter defined by the external periphery of the collar, said outer perimeter of the collar having substantially the same dimensions as the outer perimeter of the arrow shaft at the end of the arrow shaft.

6. The broadhead adapter of claim 2, wherein the bolt is a threaded arrow field tip having a shoulder and wherein the collar has an inner perimeter defining the opening and an outer perimeter defined by the external periphery of the collar, said outer perimeter of the collar having substantially the same dimensions as the outer perimeter of the arrow shaft at the end of the arrow shaft.

7. An arrow comprising:

an arrow shaft having a threaded opening at one end;

a bolt having a threaded stud and a shoulder;

a broadhead adapter comprising:

a collar having an opening, said collar being adapted to receive the stud of the bolt through the opening and said collar being further adapted to securely fit between the end of the arrow shaft having the threaded opening and the shoulder of the bolt; and at least one broadhead arrow blade attached to the collar to form a broadhead arrowhead configuration, wherein each broadhead arrow blade has a forward end and a rearward end, wherein the rearward end of each blade is attached to the collar and wherein each broadhead blade is shaped to provide an opening for insertion, tightening and removal of the bolt;

said collar being positioned between the shoulder of the bolt and the threaded opening of the arrow shaft; and said broadhead adapter being securely attached to the end of the arrow shaft having the threaded opening by meshing the threaded stud with the threads within the threaded opening of the arrow shaft.

8. The arrow of claim 7, wherein the bolt is a threaded arrow field tip having a shoulder.

9. The arrow of claim 7, wherein each broadhead blade is generally triangular in shape.

10. The arrow of claim 7, wherein the collar has an inner perimeter defining the opening and an outer perimeter defined by the external periphery of the collar, said outer perimeter of the collar having substantially the same dimensions as the outer perimeter of the arrow shaft at the end of the arrow shaft.

11. The arrow of claim 7, wherein the bolt is a threaded arrow field tip having a shoulder and wherein the collar has an inner perimeter defining the opening and an outer perimeter defined by the external periphery of the collar, said outer perimeter of the collar having substantially the same dimensions as the outer perimeter of the arrow shaft at the end of the arrow shaft.

* * * * *